US006049991A

United States Patent [19]

Gruenberg et al.

[11] Patent Number: 6,049,991

[45] Date of Patent: Apr. 18, 2000

[54] PICTURE HANGING POSITION MARKING TOOL

[75] Inventors: Raoul Gruenberg, Rancho Palos Verdes; David Dissmeyer, San Francisco, both of Calif.

[73] Assignee: David Dissmeyer, San Francisco, Calif.

[21] Appl. No.: 08/867,166

[22] Filed: Jun. 2, 1997

[51] Int. Cl.[7] ..... G01B 3/04; A47G 1/16

[52] U.S. Cl. ..... 33/613; 33/485; 33/403

[58] Field of Search ..... 33/1 G, 403, 404, 33/483, 484, 485, 489, 533, 613, 666; 248/547, 479, 476, 466, 544

[56] References Cited

U.S. PATENT DOCUMENTS

| | | | |
|---|---|---|---|
| 3,530,591 | 9/1970 | Moffitt | 33/613 |
| 4,220,309 | 9/1980 | Eisen et al. | 33/613 |
| 4,241,510 | 12/1980 | Radecki | 33/613 |
| 4,455,756 | 6/1984 | Greene | 248/547 |
| 4,517,860 | 5/1985 | Dameron, Jr. | 248/476 |
| 5,109,611 | 5/1992 | Houck | 33/666 |
| 5,180,135 | 1/1993 | Hindall | 248/544 |
| 5,471,760 | 12/1995 | Farris | 33/613 |
| 5,509,213 | 4/1996 | Kelly et al. | 33/613 |
| 5,634,279 | 6/1997 | Ariyo | 33/613 |

*Primary Examiner*—G. Bradley Bennett
*Attorney, Agent, or Firm*—John D. Gugliotta

[57] ABSTRACT

A picture hanging position marking tool is disclosed having a relatively flat, elongated support arm is a marking orifice at the distal end opposite a support arm handle. The marking orifice is bounded at its lower edge by a support cam, pivotally affixed to one side of the support arm. The support cam is comprised at its upper edge of a first hanger support ridge formed parallel to a second hanger support ridge. The two hanger support ridges bound a marking cavity between. Measuring indicia are provided along the length of the support arm, and a bubble level is located horizontally within the handle.

14 Claims, 5 Drawing Sheets

PICTURE HANGING POSITION MARKING TOOL

BACKGROUND OF THE INVENTION

1. Field of the Invention

The present invention relates generally to picture hanging aids and, more particularly, to a picture hanging position marking tool.

2. Description of the Related Art

A search of the prior art did not disclose any patents that read directly on the instant invention; however, the following references were considered related:

| U.S. Pat. No. | Inventor | Issue Date |
|---|---|---|
| 5,520,318 | Conrad B. Sloop | May 28, 1996 |
| 5,463,817 | Richard A. Leeds | November 7, 1995 |
| 5,443,238 | Lawrence Mitchell | August 22, 1995 |
| 5,398,906 | Richard M. Aydelott | March 21, 1995 |
| 5,109,611 | Ronald B. Houck | May 5, 1992 |
| 4,233,764 | Stuart R. Small | November 18, 1990 |
| D282,054 | Saul Hoffman | January 7, 1986 |

In U.S. Pat. No. 5,520,318, a picture hanging apparatus is disclosed having several drawbacks. Such an apparatus, although effective in driving a nail or other supporting apparatus into a wall, is cumbersome to use and expensive to manufacture. Further, such a device can only be used from a position above and in front of the picture, thereby causing a user's assistant to guess at the aesthetic correctness of the picture's position in merely that a user would be blocking such a view.

In U.S. Pat. No. 5,463,817, a picture frame leveling device is disclosed that merely assists a user in aligning two adjacent points to the same horizontal level.

Further, in U.S. Pat. No. 5,443,238, a framed picture hanger system is disclosed which requires the use of a specialized, two part hanger and hook. Such a system does not solve the problem of marking the correct position for driving a nail or other conventional fastener.

Of considerable relevance is U.S. Pat. No. 5,398,906, in which a wall-marking device is disclosed which indeed can assist a user in marking a wall to indicate where to install a support element such as a nail. Such a device, however, again requires either a particular type of saw-toothed bracket, or a wire suspension element, and one embodiment is not adaptable to both. Further, such a device suffers from the particular drawback of being unable to determine the balanced center of the suspension element while being used to mark the wall; such could easily result in either a picture that is not horizontally level or one that must be horizontally off center.

Another picture position marking tool is disclosed in U.S. Pat. No. 5,109,611. Such a tool also suffers from the drawbacks of the '318 patent, listed above. Further, such a tool provides a mark upon the wall in a manner that can damage the surface of the wall.

Consequently, a need has been felt for providing an apparatus that can assist a user in measuring and marking in a non-destructive fashion the location of a nail or other securement means to a wall for purposes of supporting a picture.

SUMMARY OF THE INVENTION

It is therefore an object of the present invention to provide an improved picture hanging position marking tool.

It is a feature of the present invention to provide an improved picture hanging position marking tool having an elongated, flat support arm that forms a marking orifice at its distal end, thereby allowing for a picture to be accurately and realistically placed prior to marking the position of a permanent hanger.

Briefly described according to one embodiment of the present invention, a relatively flat, elongated support arm is provided forming a marking orifice at the distal end opposite a support arm handle. The marking orifice is bounded at its lower edge by a support cam, affixed to one side of the support arm. The support cam is comprised at its upper edge of a first hanger support ridge formed parallel to a second hanger support ridge. The two hanger support ridges bound a marking cavity between. In an alternate embodiment, two such support arms are affixed at their distal ends to form a support bracket that can be grasped with two hands. Such an embodiment is envisioned as useful when utilized with exceptionally heavy wall hangings.

Further options are envisioned, such as a measuring means along the length of the support arm, and a leveling means, such as a conventional bubble level, located horizontally within the handle.

An advantage of the present invention is that it is lightweight, thereby making it easy to handle and easy to maneuver.

Another advantage of the present invention is that it allows for precise position locating for hanging of a permanent support means.

Further, the present invention allows a user to accurately mark a support location, provides steady support while positioning a picture, holds the picture securely in place until position is marked, and allows easy lifting and accurate placement of a picture or decoration.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
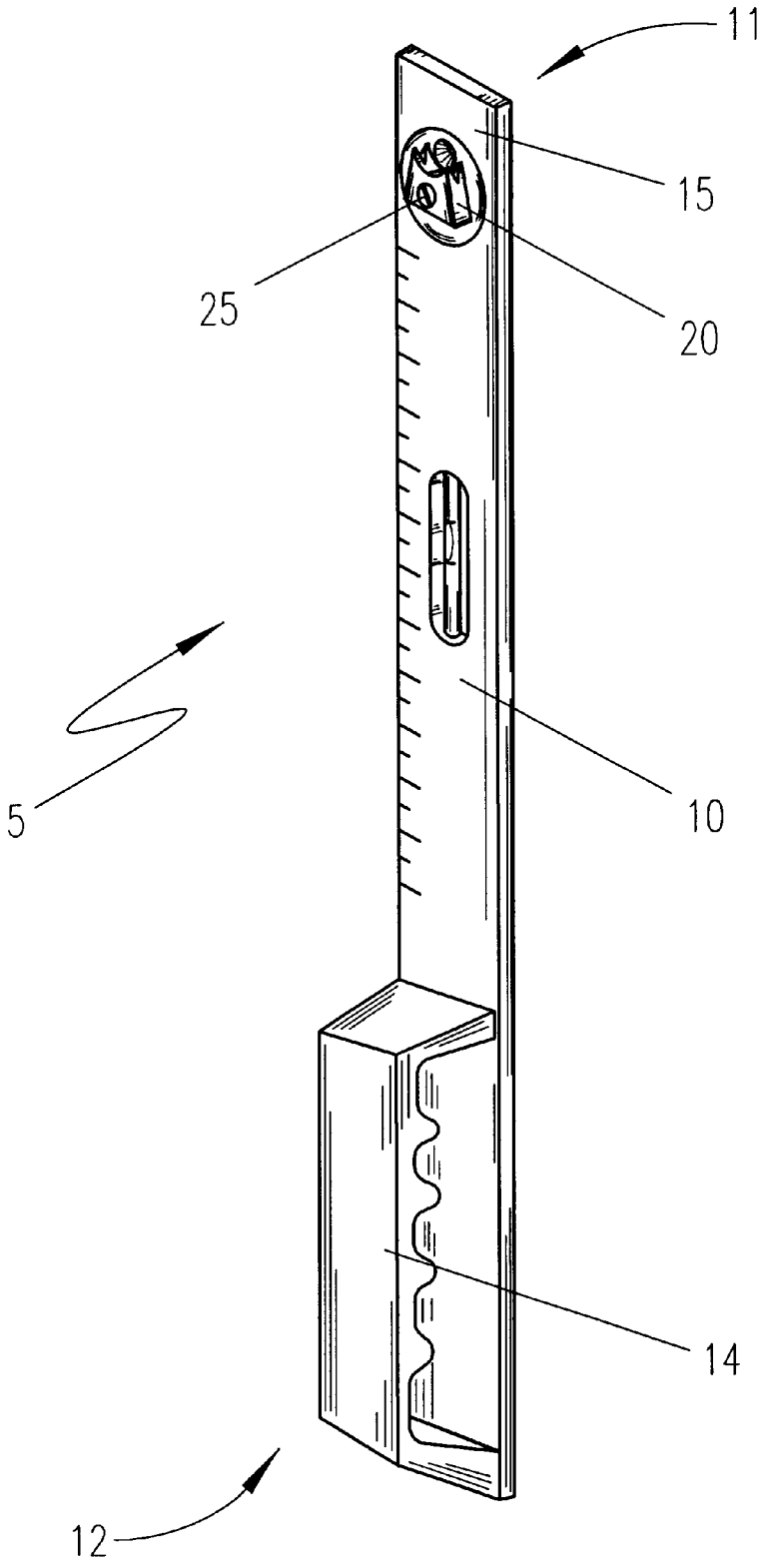
FIG. 1 is a perspective view of picture hanging position marking tool according to the preferred embodiment of the present invention.
Figure 2A:
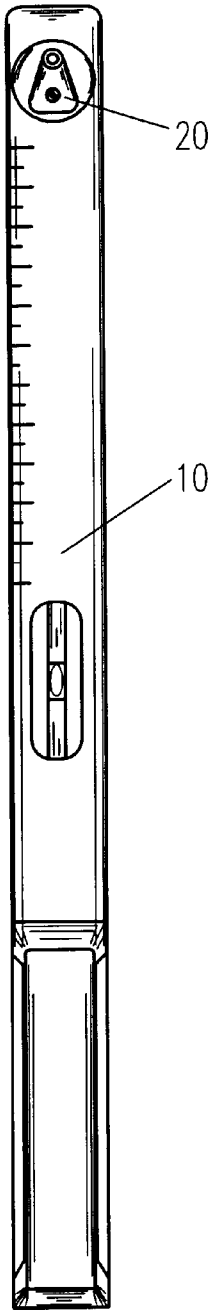
FIG. 2*a* is a front elevational view thereof.
Figure 2B:
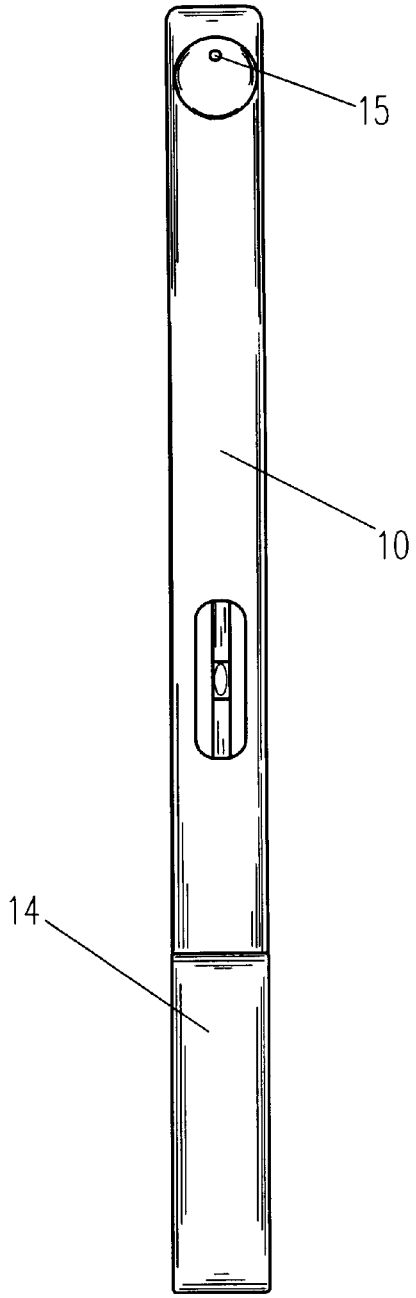
FIG. 2*b* is a rear elevational view thereof.
Figure 3A:
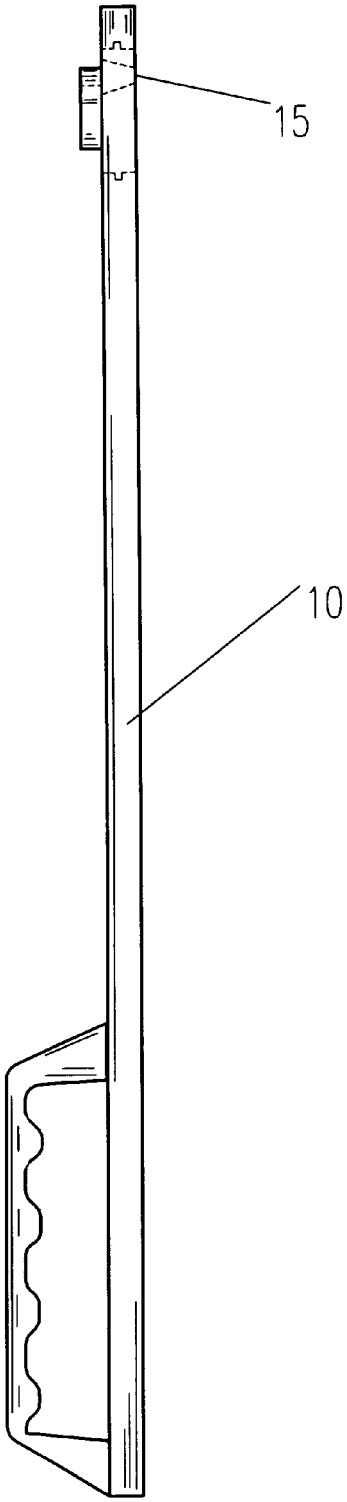
FIG. 3*a* is a left side elevational view thereof.
Figure 3B:
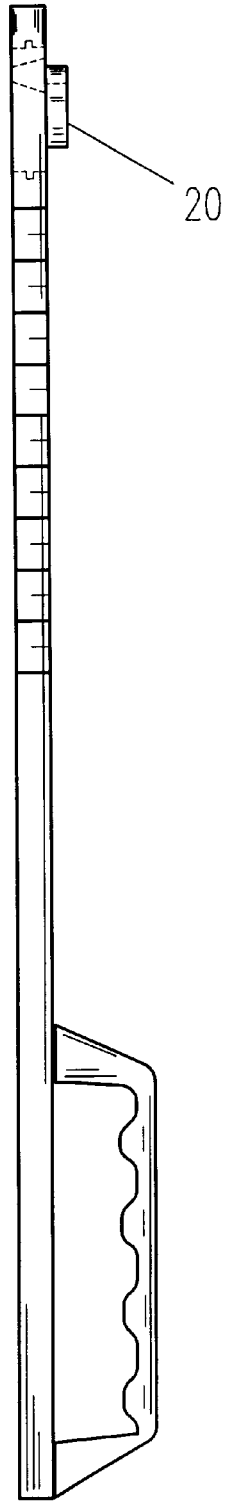
FIG. 3*b* is a right side elevational view thereof.

The best mode for carrying out the invention is presented in terms of its preferred embodiment, herein depicted within the Figures. A picture hanging position marking tool, generally noted as 5, is shown, according to one preferred embodiment of the present invention. Included is an elongated support arm 10, having a distal end 11 opposite a handle end 12 and envisioned as being comprised of a rigid yet generally thin and flat material such as metal, wood, plastic, or other suitable material. The handle end 12 forms or affixes to a support arm handle 14, thereby forming a grip portion for grasping with one's hand. At the distal end 11 a marking orifice 15 is formed completely penetrating the support arm 10 through its most narrow dimension. The marking orifice 15 is designed to allow the passage of a separate marking implement (not shown), and as such is envisioned as preferably forming a round, oval, or oblong area, although any orifice large enough to permit the passage of a marking implement, such as the writing tip of a pen or pencil, will provide the needed functionality. As shown, a round orifice 15 is depicted; with the two handled embodiments described below, an oval orifice is envisioned.

Figure 4:
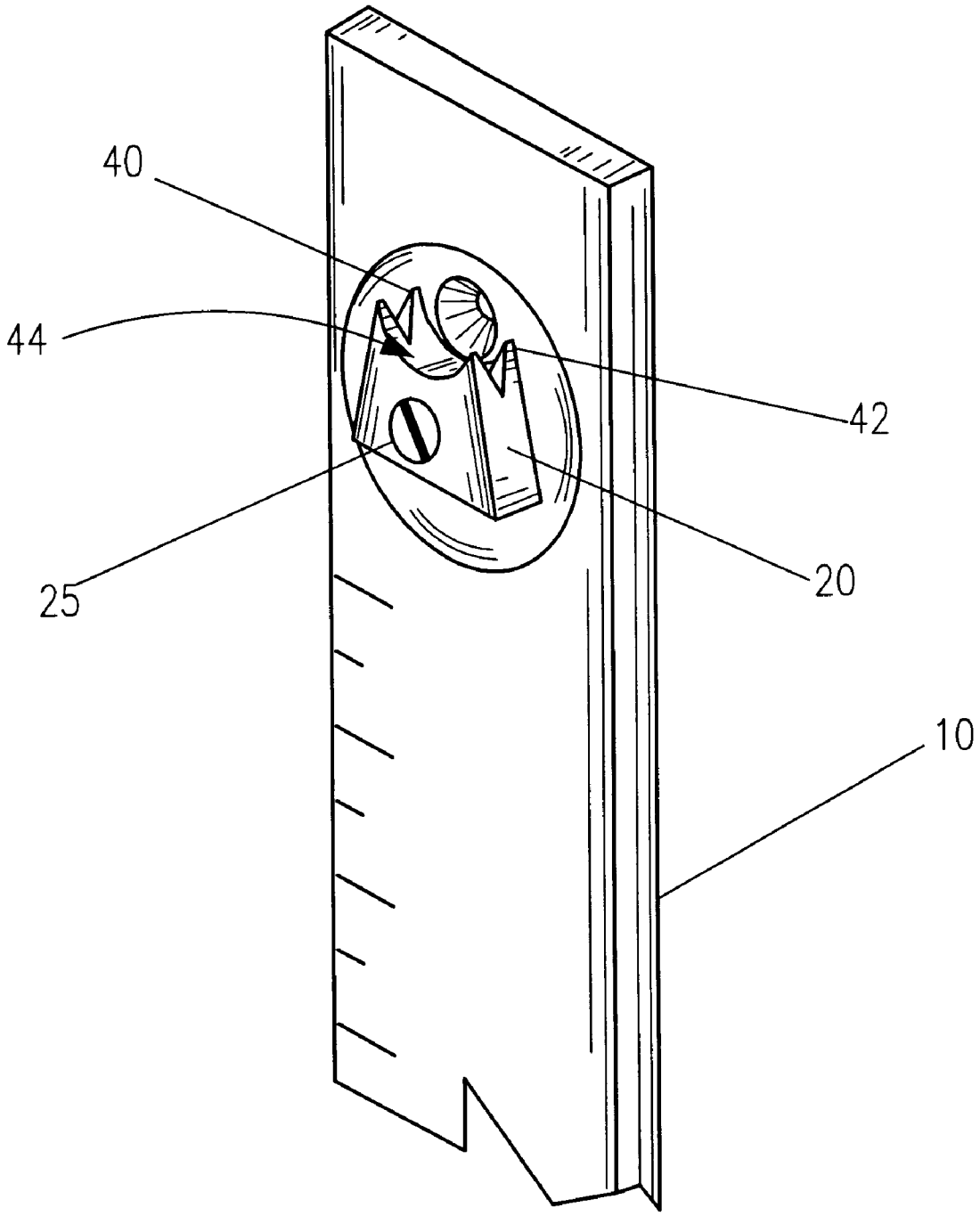
FIG. 4 is an exploded, close up perspective view of the distal end of the picture hanging tool depicted in FIG. 1.

Referring now to FIG. 4, the marking orifice 15 is bounded at its lower edge by a support cam 20. The support cam 20 is pivotally affixed to one side of the support arm 10 by a pivotal affixment means 25, herein depicted as a conventional screw fastener. The support cam 20 is comprised at its upper edge of a first hanger support ridge 40 formed generally parallel to a second hanger support ridge 42. The two hanger support ridges 40, 42 bound a marking cavity 44, formed as a general concave depression between the two extended ridges. The ridges 40, 42 are designed to support in a receiving fashion a picture hanger wire or other conventional picture hanger support. The marking cavity 44 is formed beneath the position of the picture hanger, thereby creating a marking location that can be used to accurately mark the location For driving a support member, such as a nail or screw, at a later time. The pivotal affixment means 25 can be used to adjust the support cam 20 such that it is affixed at an acute angle to the support arm 10, yet in a horizontal level position. Alternately, the support cam 20 can be affixed in a freely rotatable manner to the support arm 10 by a rotatable hinge mean. In such an embodiment, the support cam 20 will actively and continually maintain a horizonal level position as long as sufficient weight is pressing downward against the support cam. This thereby allows the user to rotate the grip portion without tilting the supported wall hanging.

Alternate embodiments are envisioned utilizing the present disclosure. For example, two such support arms are affixed at their distal ends to form a support bracket that can be grasped with two hands. In this embodiment, an oval or oblong shaped marking orifice would provide better access for the passage of a writing tip of a marking implement. Such an embodiment is envisioned as useful when utilized with exceptionally heavy wall hangings.

Further options are envisioned. These include, but are not limited to, the inclusion of measuring indicia along the length of the support arm, and a leveling means, such as a conventional bubble level, located horizontally and/or vertically within the handle. These adaptations would provide the tool 5 with a range of general purpose multifunctionality and versatility.

2. Operation of the Preferred Embodiment

Figure 5:
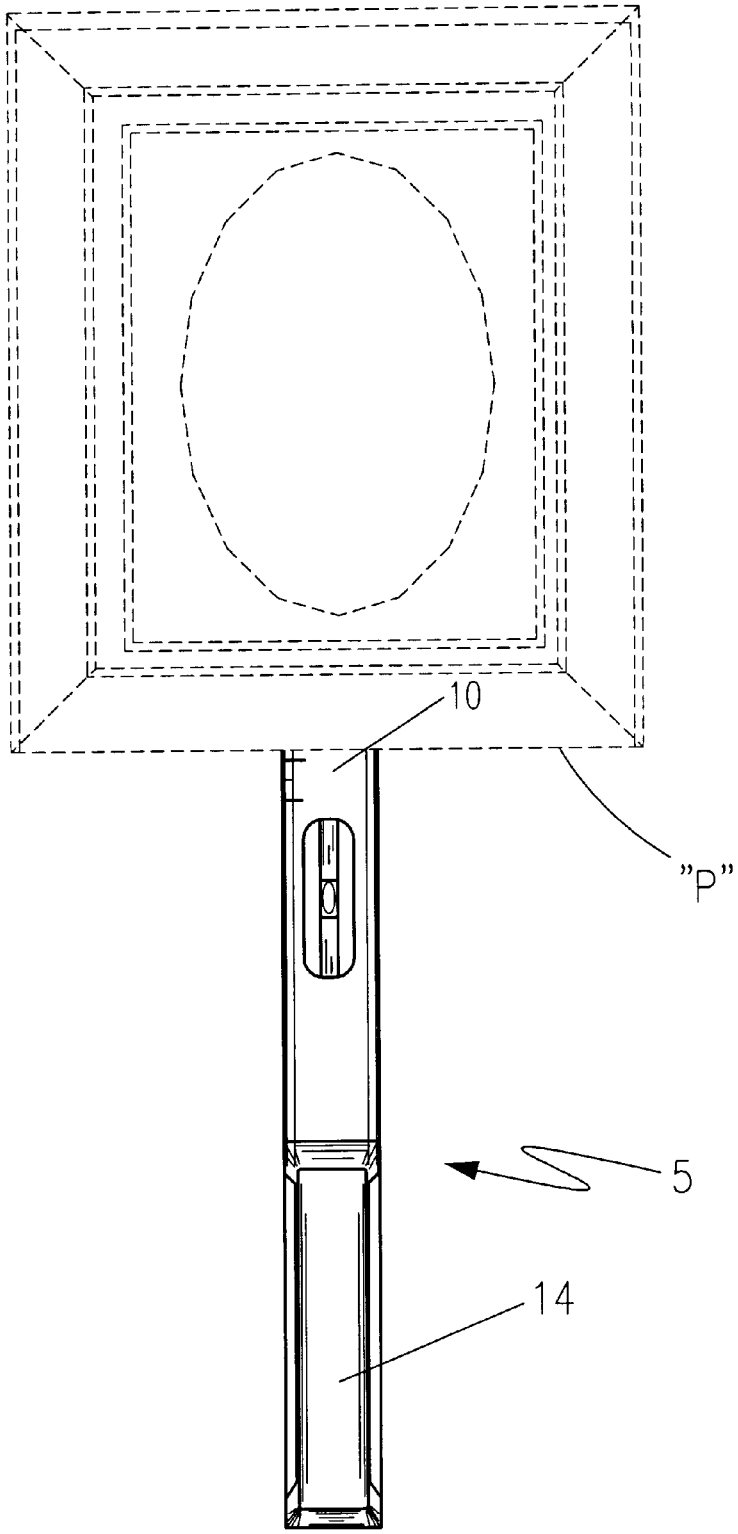
FIG. 5 is a front elevational view showing the present invention being utilized to place a picture into a proper hanging position.

As best shown in conjunction with FIG. 5, before a nail or support member is driven into the wall its spot is precisely marked with the present invention. The wire hanger or some other support attached to the picture itself is placed upon the hanger support ridges 40, 42. Using the handle 14 attached to the apparatus, the picture P or item to be hung is moved into the exact position where it will hang. The item P is then removed from the apparatus while the apparatus is held in place by the handle 14. With a pencil or some sort of writing device, a mark is placed on the wall where the support hole is located, above the marking cavity 44 but below the uppermost crests of the support ridges 40, 42. This precisely pinpoints the location where the permanent support will be located.

If the logistics of a particular installation require, the support cam can be turned via the pivotal affixment means to allow a user to mark a hanger location from a position aside the wall hanging. Further, the optional level and measuring means can assist the user in determining the appropriate support location.

The foregoing description is included to illustrate the operation of the preferred embodiment and is not meant to limit the scope of the invention. The scope of the invention is to be limited only by the following claims.

What is claimed is:

1. A picture hanging position marking tool comprising:

at least one elongated support arm having a distal end opposite a handle end, the handle end forming or affixing to a support arm handle, thereby forming a grip portion for grasping with one's hand;

a marking orifice formed at said distal end through said support arm, said marking orifice capable of allowing the passage of a separate marking implement;

a support cam, said support cam pivotally affixed to one side of the support arm by a pivotal affixment means, said support cam further bounding said marking orifice at said marking orifice's lower edge.

2. The picture hanging tool of claim 1, wherein said support arm is comprised of a rigid yet generally thin and flat material.

3. The picture hanging tool of claim 2, wherein said support arm is metal.

4. The picture hanging tool of claim 1, wherein said marking orifice forms a round hole.

5. The picture hanging tool of claim 1, wherein said support cam further comprises:

a first hanger support ridge formed at the upper edge of said support cam;

a second hanger support ridge formed at the upper edge of said support cam in a position generally parallel to said first hanger support;

and wherein said first and second hanger support ridges respectively bound a marking cavity formed as a general concave depression between the two extended ridges, thereby creating a marking location that can be used to accurately mark the location for driving a support member at a later time.

6. The picture hanging tool of claim 1, wherein said pivotal affixment means comprises a conventional screw fastener.

7. The picture hanging tool of claim 1, further comprising:

measuring indicia inscribed along the linear length of said support arm.

8. The picture hanging tool of claim 1, further comprising:

a leveling means of a conventional bubble level type, said leveling means located horizontally within said handle.

9. The picture hanging tool of claim 1, further comprising:

a leveling means of a conventional bubble level type, said leveling means located vertically within said handle.

10. The picture hanging tool of claim 9, further comprising:

a second leveling means of a conventional bubble level type, said leveling means located horizontally within said handle.

11. A picture hanging position marking tool comprising:

an elongated, rigid, generally flat, metal support arm having a distal end opposite a handle end, the handle end forming or affixing to a support arm handle, thereby forming a grip portion for grasping with one's hand, and further including measuring indicia inscribed along the linear length of said support arm;

a marking orifice formed at said distal end through said support arm, said marking orifice capable of allowing the passage of a separate marking implement;

a support cam, said support cam pivotally affixed to one side of the support arm by a pivotal affixment means, said support cam further bounding said marking orifice at said marking orifice's lower edge, said support cam further including a first hanger support ridge formed at the upper edge of said support cam, a second hanger support ridge formed at the upper edge of said support cam in a position generally parallel to said first hanger support, and wherein said first and second hanger support ridges respectively bound a marking cavity formed as a general concave depression between the two extended ridges, thereby creating a marking location that can be used to accurately mark the location for driving a support member at a later time.

12. The picture hanging tool of claim 11, further comprising:

a leveling means of a conventional bubble level type, said leveling means located horizontally within said handle.

13. The picture hanging tool of claim 11, further comprising:

a leveling means of a conventional bubble level type, said leveling means located vertically within said handle.

14. The picture hanging tool of claim 12, further comprising:

a second leveling means of a conventional bubble level type, said leveling means located horizontally within said handle.

* * * * *